US010415566B2

(12) United States Patent
Ramadoss et al.

(10) Patent No.: US 10,415,566 B2
(45) Date of Patent: Sep. 17, 2019

(54) GEAR PUMP

(71) Applicant: JOHNSON ELECTRIC INTERNATIONAL AG, Murten (CH)

(72) Inventors: Mohanlal Ramadoss, Hong Kong (CN); Wu Liu, Shenzhen (CN); Chi Hang Ngai, Hong Kong (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 298 days.

(21) Appl. No.: 14/885,748

(22) Filed: Oct. 16, 2015

(65) Prior Publication Data

US 2016/0108914 A1 Apr. 21, 2016

(30) Foreign Application Priority Data

Oct. 16, 2014 (CN) ..... 2014 1 0549523

(51) Int. Cl.
*F04C 2/18* (2006.01)
*F04C 15/00* (2006.01)

(52) U.S. Cl.
CPC ..... *F04C 15/008* (2013.01); *F04C 2/18* (2013.01); *F04C 2240/10* (2013.01); *F04C 2240/30* (2013.01); *F04C 2240/40* (2013.01)

(58) Field of Classification Search
CPC .... F04C 2/18; F04C 2240/40; F04C 2240/30; F04C 15/008; F04C 2/14; F04C 2240/10;
(Continued)

(56) References Cited

U.S. PATENT DOCUMENTS 1,686,867 A * 10/1928 Kuhn ..... F04C 2/084 418/190
2,481,143 A * 9/1949 Muller ..... F04C 2/14 184/31

(Continued)

FOREIGN PATENT DOCUMENTS

CN 202309274 U 7/2012
CN 203756517 U 8/2014

(Continued)

OTHER PUBLICATIONS

Magnequench Bonded Neo Magnetization Guide, by Sheth, published 2009.*

(Continued)

*Primary Examiner* — Charles G Freay
*Assistant Examiner* — Thomas Fink
(74) *Attorney, Agent, or Firm* — Muncy, Geissler, Olds & Lowe, P.C.

(57) ABSTRACT

A gear pump has a pump body, a pump cylinder connected with the pump body, a driving gear and a driven gear meshed with each other and disposed in the pump cylinder, and a motor driving the driving gear through a driving shaft. The pump cylinder is located between the pump body and the motor. The driving gear is mounted to or integrally formed with the driving shaft. A first bearing and a second bearing are disposed on respectively sides of the driving gear, one end of driving shaft is received in the first bearing, and the other end of the driving shaft extends through the second bearing and into the motor and forms a shaft of the motor.

16 Claims, 14 Drawing Sheets

(58) Field of Classification Search
CPC ..... F04C 2240/20; F04C 2240/80; F04C 2240/801; H02K 1/27–2793; H02K 5/12; H02K 5/20; H02K 5/1285; H02K 5/22; H02K 1/132; H02K 9/00; H02K 9/02
USPC ..... 310/52, 54, 87, 58, 59, 60 R, 62, 63
See application file for complete search history.

(56) References Cited

U.S. PATENT DOCUMENTS 3,502,033 A * 3/1970 Kaczrowski ..... F04C 2/18 418/200
3,574,492 A * 4/1971 Schwary ..... F01C 1/086 384/202
3,659,958 A * 5/1972 Schulte ..... F04D 19/042 416/199
3,690,793 A * 9/1972 Pollman ..... F04C 15/0026 418/102
4,160,630 A 7/1979 Wynn
4,298,319 A * 11/1981 Glidden ..... F04C 15/0026 418/132
4,311,444 A * 1/1982 Shumate ..... F04C 15/0042 418/131
4,438,361 A * 3/1984 Manson ..... H02K 5/1732 310/49.16
4,846,641 A 7/1989 Pieters et al.
4,910,861 A * 3/1990 Dohogne ..... H02K 1/278 264/272.2
5,190,450 A * 3/1993 Ghosh ..... F01C 21/02 384/114
5,244,367 A * 9/1993 Aslin ..... B67D 7/02 418/104
5,273,411 A * 12/1993 Lipscombe ..... F04C 2/086 418/131
5,466,131 A * 11/1995 Altham ..... B41J 2/17596 184/6.12
5,702,234 A * 12/1997 Pieters ..... F01C 21/10 417/420
5,704,717 A * 1/1998 Cochimin ..... F16C 17/22 310/87
5,704,767 A * 1/1998 Johnson ..... F04C 11/00 417/43
5,842,848 A * 12/1998 Knowles ..... F04C 2/14 418/196
6,325,604 B1 * 12/2001 Du ..... F04C 2/082 264/331.11
6,365,998 B1 * 4/2002 Kech ..... H02K 3/47 310/194
6,808,374 B2 * 10/2004 Phallen ..... F04C 2/086 418/132
6,983,529 B2 1/2006 Ortt et al.
2003/0160525 A1 * 8/2003 Kimberlin ..... F04C 11/008 310/63
2004/0179953 A1 * 9/2004 Suzuki ..... F04C 2/086 417/310
2006/0140791 A1 * 6/2006 Deming ..... F04C 18/3564 417/410.3
2007/0253855 A1 * 11/2007 Tsubono ..... F04C 2/084 418/61.3
2009/0060728 A1 * 3/2009 Grimes ..... F04B 7/06 415/200
2009/0311120 A1 * 12/2009 Okada ..... F04C 2/18 418/73
2010/0200072 A1 * 8/2010 Heitzler ..... F04C 2/084 137/1
2010/0202913 A1 * 8/2010 Shimamura ..... F01C 21/10 418/206.1
2011/0062819 A1 * 3/2011 Lyons ..... H02K 15/0012 310/261.1
2011/0293450 A1 * 12/2011 Grimes ..... F04B 17/03 417/420
2013/0183178 A1 * 7/2013 Bottan ..... F04D 13/08 417/423.3
2013/0294940 A1 * 11/2013 Matz ..... F01C 21/02 417/53
2014/0294627 A1 * 10/2014 Wu ..... F04C 2/18 417/410.4
2015/0267699 A1 * 9/2015 Pippes ..... F04C 2/084 417/410.4

FOREIGN PATENT DOCUMENTS

CN 104074741 A 10/2014
GB 864915 A 3/1961

OTHER PUBLICATIONS

The Ultimate Retaining Ring Guide, by Rotor Clip Company, downloaded Feb. 9, 2019.*

* cited by examiner

GEAR PUMP

CROSS REFERENCE TO RELATED APPLICATIONS

This non-provisional patent application claims priority under 35 U.S.C. § 119(a) from patent application Ser. No. 201410549523.1 filed in The People's Republic of China on Oct. 16, 2014, the entire contents of which are hereby incorporated by reference.

FIELD OF THE INVENTION

This invention relates to a pump and in particular, to a gear pump.

BACKGROUND OF THE INVENTION

A gear pump typically includes a pump cylinder, and a driving gear and a driven gear received in the pump cylinder. The driving gear and the driven gear are meshed with each other. When rotating, the driving gear and driven gear continuously engage and disengage, resulting in a change in a work volume formed between the pump cylinder and the meshed gears, such that the fluid is delivered or pressurized. The two gears and pump cylinder are usually required to be intimately assembled to prevent the fluid from directly flowing through the gap between teeth of the two gears or through the gap between the gears and the pump cylinder. However, each component has a certain tolerance. During operation, collision between the gears and the pump cylinder may occur which would generate noise.

SUMMARY OF THE INVENTION

Hence there is a desire for a gear pump having an improved structure or which at least provides a useful alternative.

Accordingly, in one aspect thereof, the present invention provides a gear pump comprising: a pump body; a pump cylinder connected with the pump body; a driving gear and a driven gear meshed with each other and disposed in the pump cylinder; a motor driving the driving gear; and a driving shaft, the driving gear being mounted to or integrally formed with the driving shaft and rotatably supported by a first bearing and a second bearing respectively disposed on opposite sides of the driving gear, wherein the pump cylinder is disposed between the pump body and the motor, one end of driving shaft is received in the first bearing, and the other end of the driving shaft extends through the second bearing and into the motor to form a shaft of the motor.

Preferably, the pump body has a driving shaft hole, the first bearing is received in the driving shaft hole, a washer made of wear-resistant and/or high temperature resistant material is disposed between the pump body and an end surface of the driving gear, the washer defines a through hole, and the driving shaft passes through the through hole of the washer.

Preferably, the pump cylinder forms a first shaft hole, the second bearing is received in the first shaft hole, a washer made of wear-resistant and/or high temperature resistant material is disposed between the pump cylinder and an end surface of the driving gear, the washer defines a through hole, and the driving shaft passes through the through hole of the washer.

Preferably, the second bearing is an integral part of the pump cylinder.

Preferably, an outer edge of the washer extends beyond an outer edge of the driving gear, a groove is formed in a side of the washer adjacent the driving gear, and the groove extends to where the driving gear and the driven gear are meshed with each other.

Preferably, the pump has a driven shaft on which the driven gear is attached or integrally formed, the pump body has a driven shaft hole, the pump cylinder has a second shaft hole corresponding to the driven shaft hole, a third bearing is disposed in the driven shaft hole, a fourth bearing is disposed in the second shaft hole, opposite ends of the driven shaft are respectively received in the third and fourth bearing, and washers made of wear resistant and/or high temperature resistant material are respectively disposed between the third and fourth bearings and respective end surfaces of the driven gear.

Preferably, the washer has another through hole corresponding to the driven shaft.

Preferably, a groove is formed in a side of the washer adjacent the driving gear and driven gear, and the groove extends from the through hole towards an area where the driving gear and the driven gear are meshed with each other.

Preferably, the groove fluidly connects the through hole with the another through hole.

Preferably, the motor comprises a rotor attach to the driving shaft, a stator surrounding the rotor, a sealing member disposed between the rotor and the stator, and an outer housing in which the stator is fixed, one end of the outer housing adjacent the pump cylinder forms a through hole, one end of the sealing member extends through the through hole of the outer housing and is connected with the pump cylinder, and an outer surface of the sealing member contacts a wall surface of an inner hole of the stator.

Preferably, the rotor is rotatably received in the sealing member, one end of the sealing member remote from the pump cylinder forms a third shaft hole, and the other end of the driving shaft passes through the rotor and is loosely inserted into the third shaft hole.

Preferably, a distance between the first bearing and the second bearing is greater than a distance between the second bearing and a radial plane on which a center of gravity of the rotor is located.

Preferably, one end of the sealing member remote from the pump cylinder forms a third shaft hole, a fifth bearing is disposed in the third shaft hole, and the other end of the driving shaft passes through the rotor and is rotatably inserted into the fifth bearing.

Preferably, the rotor comprises a housing, a rotor core received in the housing, a magnet disposed between the rotor core and the housing, and an insulating member, the insulating member is directly formed over the housing, rotor core and magnet to form an integral structure by a molding process, the magnet and rotor core are sealed in a closed space formed by the housing and the insulating member, and the insulating member forms a through hole for receiving the driving shaft.

Optionally, the magnet is a ring magnet that is obliquely magnetized.

Optionally, the housing is made of a non-magnetic metal material.

Optionally, the sealing member is made of a non-magnetic metal material.

Preferably, the rotor defines therein a through hole with a waist-shaped cross section, a portion of the driving shaft received in the waist-shaped through hole has a waist-shaped cross section, such that relative rotation between the rotor and the driving shaft is limited.

Preferably, the rotor defines therein a through hole and a keyway in communication with the through hole, a key is disposed in the keyway, the driving shaft forms a cutting groove at a location corresponding to the key, matching surfaces of the key and the driving shaft are planar surfaces, such that relative rotation between the rotor and the driving shaft is limited.

Preferably, an axial height of the cutting groove is greater than an axial height the key, a locking groove is formed in the driving shaft corresponding to the cutting groove, the locking groove is located on a side of the rotor remote from the pump cylinder, and a retaining ring is disposed in the locking groove to limit axial movement of the rotor.

Preferably, at least one baffle block is formed at one end of the pump cylinder adjacent the motor.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
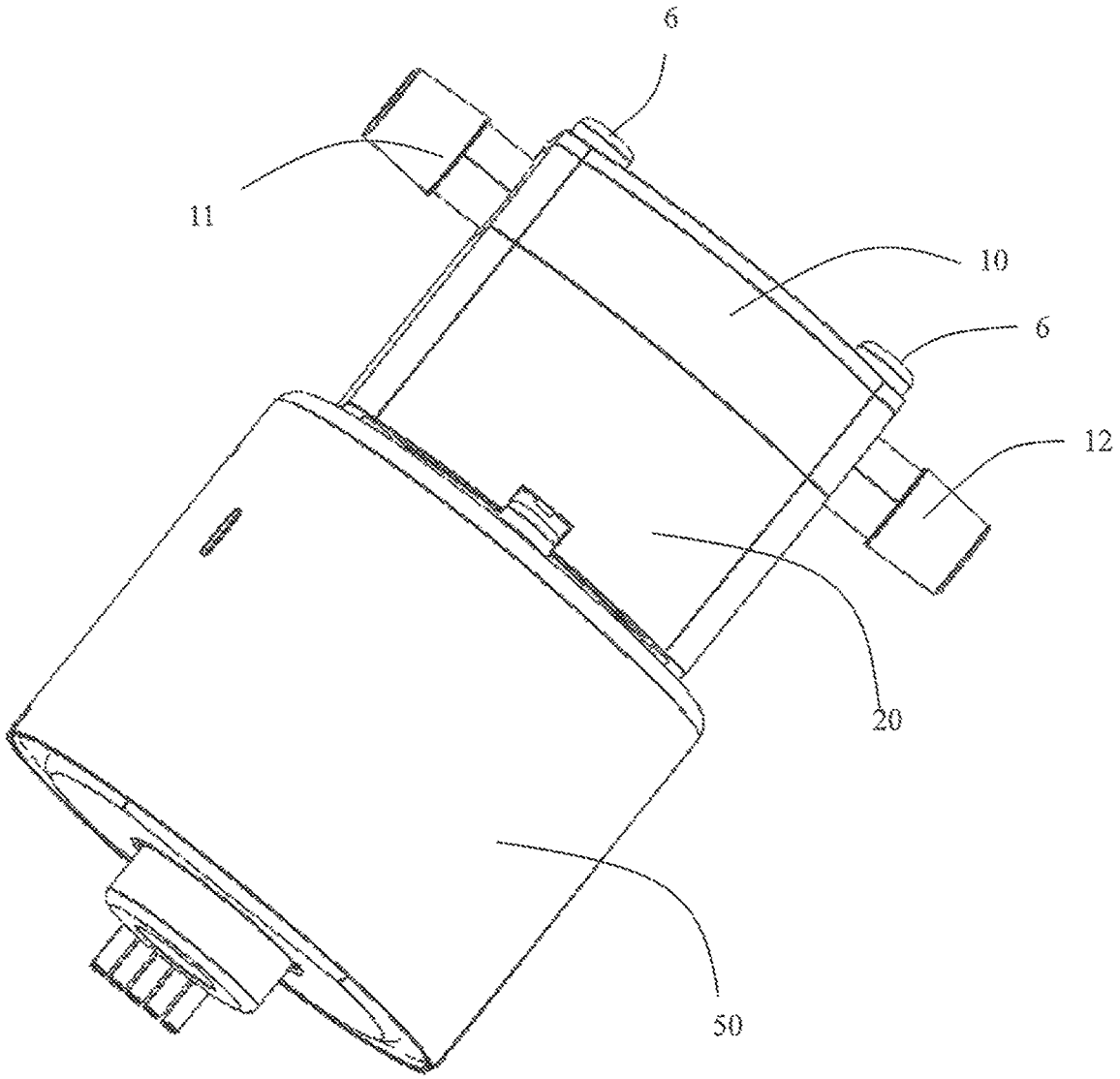
FIG. 1 is a perspective view of a gear pump according to one embodiment.
Figure 2:
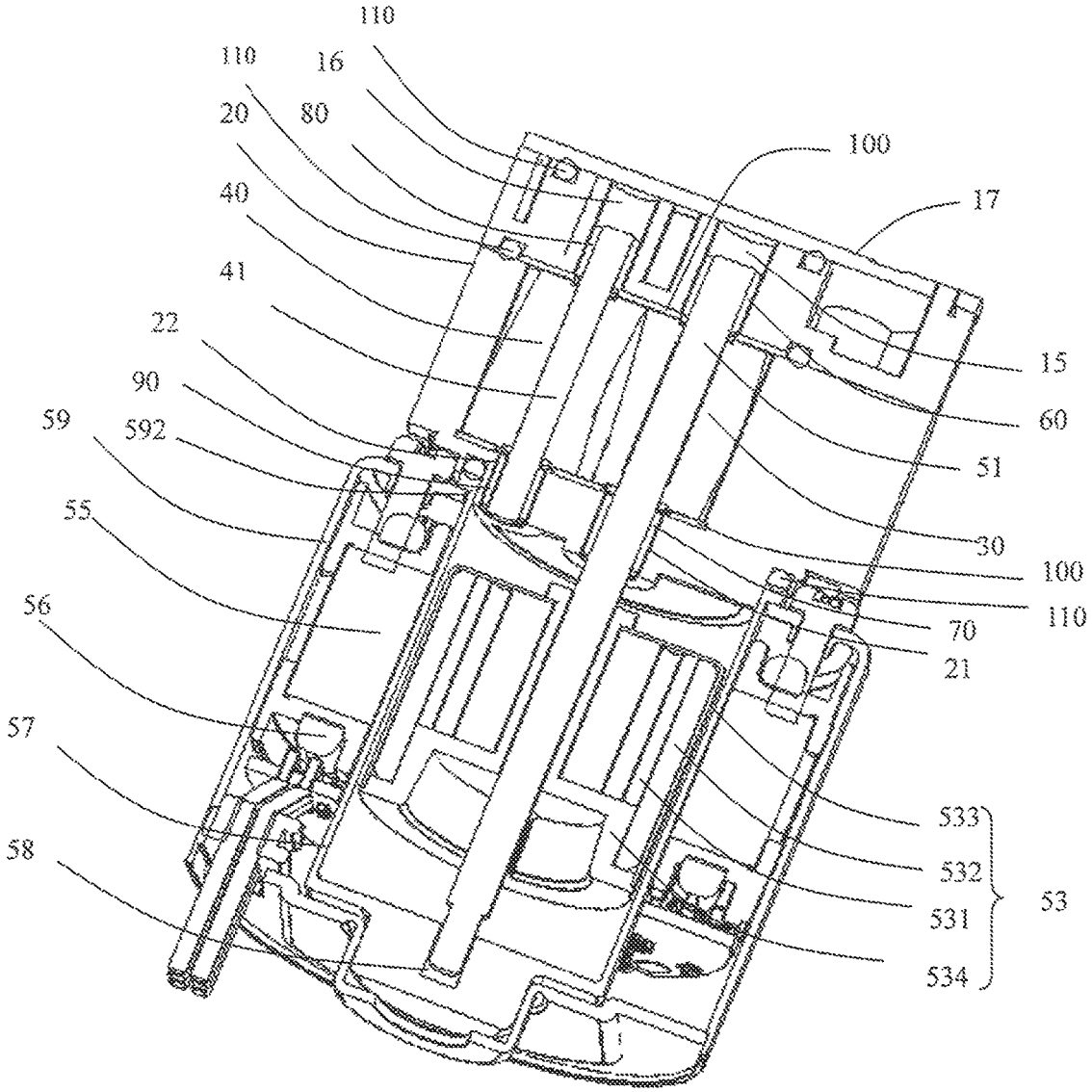
FIG. 2 is a sectional view of the gear pump of FIG. 1.
Figure 3:
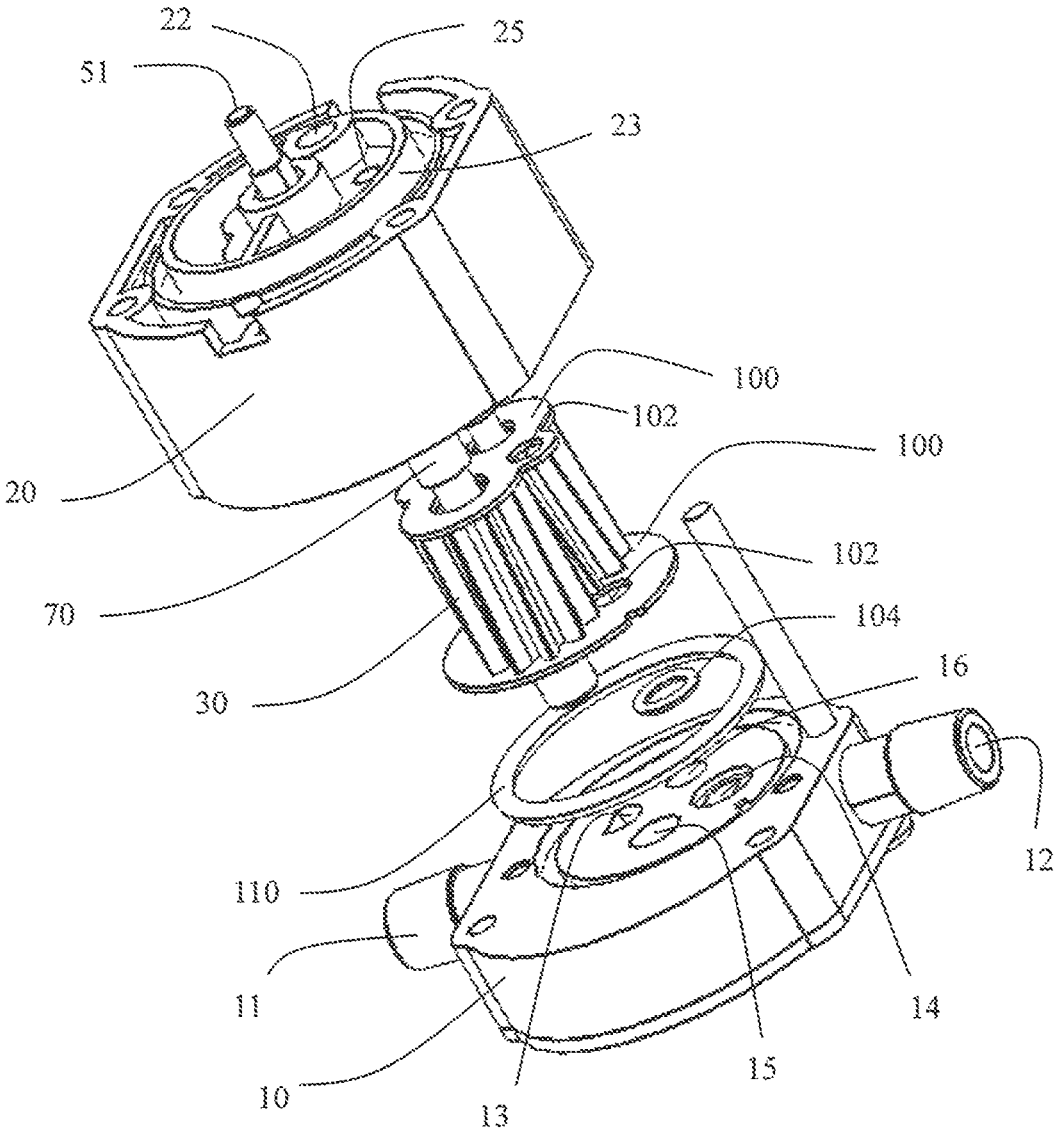
FIG. 3 is an exploded view of a pump section of the gear pump of FIG. 1, including a pump body and a pump cylinder.
Figure 4:
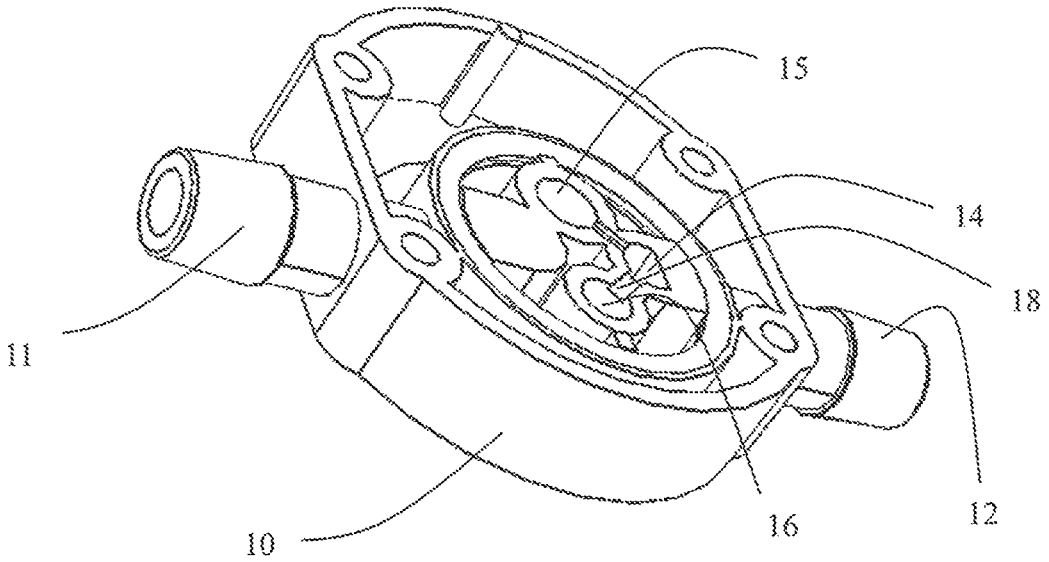
FIG. 4 illustrates the pump body of FIG. 3.

Referring to FIGS. 1 to 4, a gear pump in accordance with one embodiment of the present invention includes a pump body 10, a pump cylinder 20, a driving gear 30 received in the pump cylinder 20, a driven gear 40 meshed with the driving gear 30, and a motor 50 for driving the driving gear 30. The pump body 10, pump cylinder 20 and motor 50 are mounted together via screws 6 or other fasteners. The pump cylinder 20 is disposed between the pump body 10 and the motor 50. Sealing rings 110 are disposed at a connecting area between the pump body 10 and the pump cylinder 20, a connecting area between the pump body 10 and a cover 17, and a connecting area between the pump cylinder 20 and the motor 50, to prevent fluid leakage.

The pump body 10 forms a fluid inlet 11 and a fluid outlet 12 via which the fluid flows into and out of the pump body 10, respectively. The fluid inlet 11 and the fluid outlet 12 do not communicate with each other within the pump body 10, such that the fluid entering the pump body 10 via the fluid inlet 11 does not directly flow out of the pump body 10 via the fluid outlet 12. An end surface of the pump body 10 facing the pump cylinder 20 forms an entrance 13, an exit 14, a driving shaft hole 15, and a driven shaft hole 16. The entrance 13 communicates with the fluid inlet 11 to direct the fluid in the pump body 10 into the pump cylinder 20. The exit 14 communicates with the fluid outlet 12 to direct the fluid in the pump cylinder 20 into the pump body 10, and the fluid is eventually discharged out of the pump body 10 via the fluid outlet 12. While the fluid flows through the pump cylinder 20, the driving gear 30 and the driven gear 40 interact to pressurize the fluid. A driving shaft 51 and a driven shaft 41 are disposed in the driving shaft hole 15 and the driven shaft hole 16 to support the driving gear 30 and the driving gear 40 for rotation, respectively. Preferably, the driving shaft hole 15 and the driven shaft hole 16 are both through holes, each of which communicates with the exit 14 via a fluid passage 18 (FIG. 4), allowing the fluid to enter the driving shaft hole 15 and driven shaft hole 16 to lubricate the driving shaft 51 and driven shaft 41 received therein.

The pump cylinder 20 defines a receiving space for receiving the driving gear 30 and the driven gear 40. An end of the pump cylinder 20 facing the pump body 10 is an open end, and an opposite end of the pump cylinder 20 facing the motor 50 is a closed end having a first shaft hole 21 and a second shaft hole 22, which are both through holes. The first shaft hole 21 corresponds to and is coaxial with the driving shaft hole 15 of the pump body 10, and the second shaft hole 22 corresponds to and is coaxial with the driven shaft hole 16. Preferably, the driving gear 30 is secured to the driving shaft 51 by an insert-molding process and rotates with the driving shaft 51. One end of the driving shaft 51 extends out of the driving gear 30 and is received in the driving shaft hole 15 of the pump body 10, and the other end extends through the first shaft hole 21 of the pump cylinder 20 and into the interior of the motor 50. Preferably, the driving shaft 51 integrally and outwardly extends from an output shaft of the motor 50. The driven gear 40 is fixedly mounted to the driven shaft 41. Both ends of the driven shaft 41 extend out of the driven gear 40, with one end disposed in the second shaft hole 22 of the pump cylinder 20, and the other end disposed in the driven shaft hole 16 of the pump body 10. Understandably, the gears 30, 40 and shafts 51, 41 may be connected by a movable connection as long as the gears 30, 40 rotate with the respective shafts 51, 41.

A first bearing 60 connects the driving shaft 51 to the pump body 10. A second bearing 70 connects the driving shaft 51 to the pump cylinder 20. The driving gear 30 is disposed between the first bearing 60 and the second bearing 70. That is, the bearings 60, 70 support the driving shaft 51 at opposite sides of the driving gear 30. The first bearing 60 and the second bearing 70 have the same construction and are both cylindrically shaped. The first bearing 60 is attached around the driving shaft 51 and fixedly received in the driving shaft hole 15 of the pump body 10. An outer diameter of the first bearing 60 is approximately the same as an inner diameter of the driving shaft hole 15, such that the driving shaft 51 can be stably supported without wobbling. Similarly, the second bearing 70 is attached around the driving shaft 51 and fixedly received in the first shaft hole 21. A third bearing 80 connects the driven shaft 41 to the pump body 10. A fourth bearing 90 connects the driving shaft 41 to the pump cylinder 20. The driven gear 40 is disposed between the third bearing 80 and the fourth bearing 90. The third bearing 80 and the fourth bearing 90 have the same construction and are both cylindrically shaped. The third bearing 80 is attached around the driven shaft 41 and fixedly received in the driven shaft hole 16 of the pump body 10. The fourth bearing 90 is attached around the driven shaft 41 and fixedly received in the second shaft hole 22.

Figure 5A:
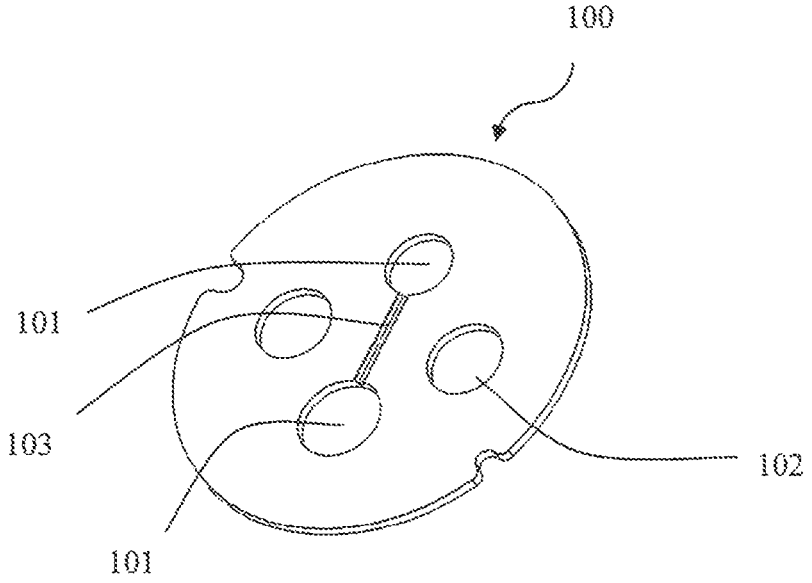
FIG. 5A to FIG. 5C are perspective views of a washer of the gear pump according to various embodiments.
Figure 5B:
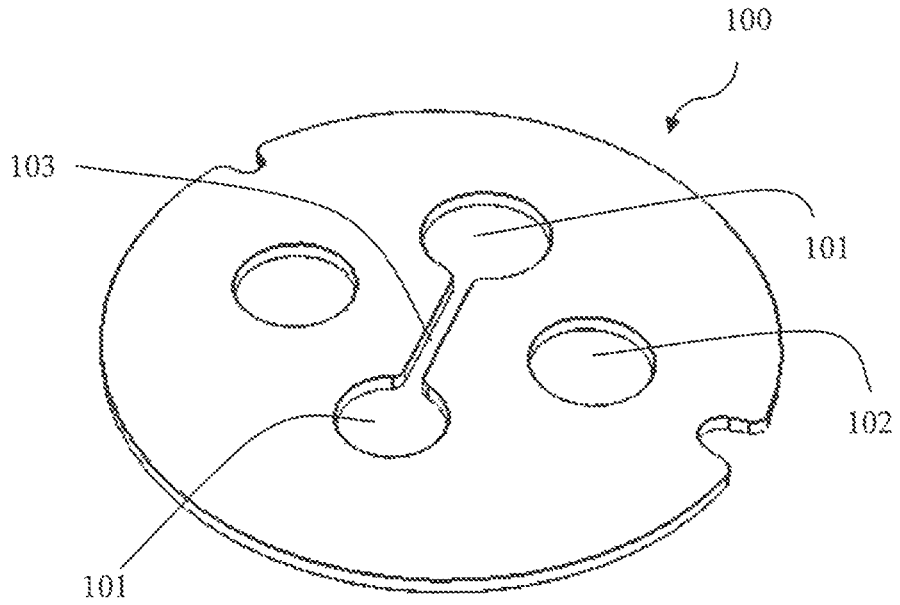
Figure 5C:
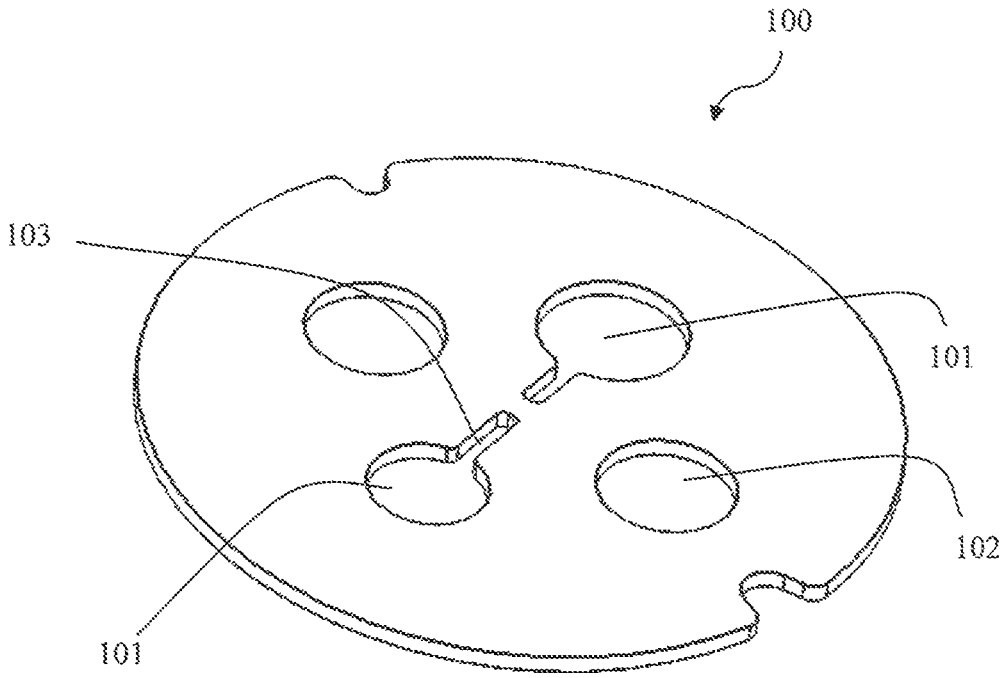

Referring to FIGS. 2, 3 and 5A to 5C, a washer 100 is disposed between the first bearing 60 and an end surface of the driving gear 30 and between the third bearing 80 and an end surface of the driven gear 40, to separate the pump body 10 from the driving gear 30 and driven gear 40 to avoid direct contact between the pump body 10 and the end surfaces of the gears 30, 40. The washer 100 is made of a wear-resistant and/or high temperature resistant material such as stainless steel. Similarly, a further washer 100 is also disposed between the second bearing 70 and the end surface of the driving gear 30 and between the fourth bearing 90 and the end surface of the driven gear 40, to separate the pump cylinder 20 from the driving gear 30 and driven gear 40 to avoid direct contact between the pump cylinder 20 and the end surfaces of the gears 30, 40. Preferably, the size of each washer 100 is greater than the size of the driving gear 30 and the driven gear 40 so that an outer edge of the washer 100 extends beyond an outer edge of the driving gear 30 and driven gear 40. Each washer 100 has through holes 101 corresponding to the driving shaft 51 and driven shaft 41. A groove 103 is formed in a side of the washer 100 facing the gear 30, 40. The groove 103 extends from the two through holes 101 to where the driving gear 30 and the driven gear 40 are meshed. The two parts of groove 103 extending from the corresponding through holes may communicate with each other as shown in FIG. 5A and FIG. 5B. Alternatively, the two parts of the groove 103 may not communicate with each other as shown in FIG. 5C. The groove 103 may extend through the washer 100 in the axial direction of the pump as shown in FIG. 5B and FIG. 5C. Alternatively, the groove 103 may not extend through the washer 100 in the axial direction of the pump as shown in FIG. 5A. The groove 103 allows the fluid to flow into the area between end surfaces of the gears 30, 40 and the washer 100 for lubrication, thus reducing friction between the gears 30, 40 and the washer 100.

The washer 100 between the pump body 10 and the gears 30, 40 is disposed at an inside of the sealing ring 110. The washer 100 has a through hole 102 corresponding to each of the fluid inlet 13 and fluid outlet 14 of the pump body 10 to connect the receiving space of the pump cylinder 20 with the fluid inlet 13 and fluid outlet 14. Optionally, a sealing ring 104 is disposed between the washer 100 and the pump body 10 and surrounds the fluid outlet 14 to prevent back flow of the high pressure fluid from the fluid outlet 14. The washer 100 between the pump cylinder 20 and the gears 30, 40 has a through hole 102 corresponding to the fluid outlet 14 of the pump body 10. The pump cylinder 20 forms a through hole 25 corresponding to the through hole 102, such that the fluid not only can flow into between the driving shaft 51, driven shaft 41 and the bearings 60, 80 for lubrication via the driving shaft hole 15, driven shaft hole 16, but it also can flow into between the driving shaft 51, driven shaft 41 and the bearings 70, 90 for lubrication via the through holes 102, 25.

The motor 50 includes a rotor 53 connected to the driving shaft 51, a stator 55 surrounding the rotor 53, a sealing member 57 disposed between the stator 55 and the rotor 53, and an outer housing 59 for receiving these components. The driving shaft 51 forms an output shaft of the motor.

The outer housing 59 is cylindrically shaped. One end of the outer housing 59 facing the pump cylinder 20 forms a through hole 592 that is coaxial with the outer housing 59. A stator core of the stator 55 is fixed to an inner surface of the outer housing 59. The inner surface of the outer housing 59 is taken as a reference surface for assembly of the stator 55. The sealing member 57 is a cylindrical structure with one closed end and made of a non-magnetic material. The sealing member 57 is disposed in an inner bore of the stator core. The rotor 53 is disposed within the sealing member 57, with a first gap formed between the sealing member 57 and the rotor 53 to allow the rotor to rotate. The closed end of the sealing member 57 is the end of the sealing member 57 remote from the pump cylinder. The closed end forms a third shaft hole 58. Another end of the driving shaft 51 passes through the rotor 53 and is loosely inserted into the third shaft hole 58. A second gap is formed between the driving shaft 51 and a wall surface of the sealing member that defines the third shaft hole 58. The second gap is smaller than the first gap to prevent the rotor 53 from coming into contact with the sealing member 57 should the driving shaft bend or flex during rotation. The other end of the sealing member 57 is an open end which extends out of the outer housing 59 via the through hole 592 and is sealingly connected with the pump cylinder 20.

Preferably, an annular flange 23 axially protrudes from one end of the pump cylinder 20 facing the motor 50. The annular flange 23 surrounds and is radially spaced a distance from the first and second shaft holes 21, 22. A space is formed between the annular flange 23 and the first, second shaft holes 21, 22. An outer diameter of the annular flange 23 is approximately the same as an inner diameter of the sealing member 57. On assembly, the annular flange 23 is inserted into the open end of the sealing member 57 to contact an inner surface of the sealing member 57. A sealing ring 110 is disposed at a connecting area between the open end of the sealing member 57 and the pump cylinder 20 to prevent leakage of the fluid which may cause a short-circuit of windings 56 of the stator 55 mounted outside the sealing member 57. Preferably, an outer surface of the sealing member 57 contacts a surface of the inner bore of the stator core, and the inner surface of the sealing member 57 is taken as the reference surface during assembly of the pump cylinder 20, such that the stator 55, rotor 53 and driving gear 30 received in the pump cylinder 20 can be assembled with good coaxiality.

Figure 6:
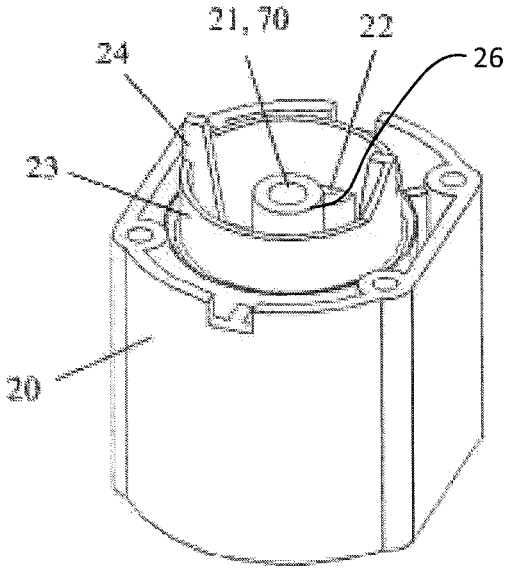
FIG. 6 is a perspective view of the pump cylinder of the gear pump according to another embodiment.
Figure 7:
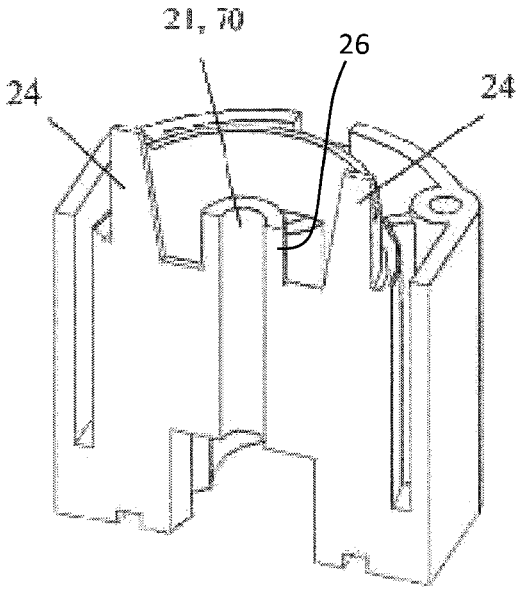
FIG. 7 is a sectional view of the pump cylinder of FIG. 6.

FIGS. 6 and 7 illustrate the pump cylinder 20 of the gear pump according to another embodiment. The difference between this embodiment and the previous embodiment is that, in this embodiment, a middle of the end of the pump cylinder 20 facing the motor 50 extends outwardly to form the second bearing 70. That is, in this embodiment, the second bearing 70 is integrally formed with the pump cylinder 20. The first shaft hole 21 axially extends through the bearing 70, which avoids problems related to coaxiality during assembly of a separate bearing with the pump cylinder 20 and the gear mesh problem between the gears 30, 40 due to non-uniform thickness of the second bearing. The driving shaft 51 passes through the first shaft hole 21 and enters the interior of the motor 50, which ensures the precise assembly of the driving gear 30 with the pump cylinder, such that the driving gear 30 can operate steadily with reduced noise and wear.

In addition, the end of the pump cylinder 20 facing the motor 50 is further provided with at least one baffle block 24. The baffle block 24 extends radially inwardly from the annular flange 23. A radial inner end of the baffle block 24 is spaced a distance from the first, second shaft holes 21, 22. The baffle block 24 is used to form turbulence in the flow of fluid. There may be a single or multiple baffle blocks 24. In the illustrated embodiment, there are two baffle blocks 24 that are symmetrically disposed. Each baffle block 24 is generally in the shape of a right trapezoid. A radial width of the baffle block 24 gradually decreases in a direction away from the pump cylinder 20. A distal end of the baffle block 24 extends axially beyond the annular flange 23. Some liquid such as dialysate resides in the gear pump and cannot be easily removed. In this invention with the baffle blocks 24 formed on the pump cylinder 20, when the rotor 53 rotates to drive the cleaning fluid to perform the cleaning operation, the cleaning fluid in the pump cylinder 20 is driven to enter between the pump cylinder 20 and the rotor 53 via the clearance between the shaft and shaft hole; the cleaning fluid rotating along with the rotor impinges on the baffle blocks 24, thus forming turbulence and hence a high pressure zone at a back side of the baffle blocks 24. This high pressure facilitates the cleaning fluid entering a bottom end of the sealing member 57 via the gap between the sealing member 57 and a rotor housing 533 to remove the dialysate residing at the bottom end of the sealing member 57, thus enhancing the efficiency of cleaning the gear pump of the present invention.

Figure 8:
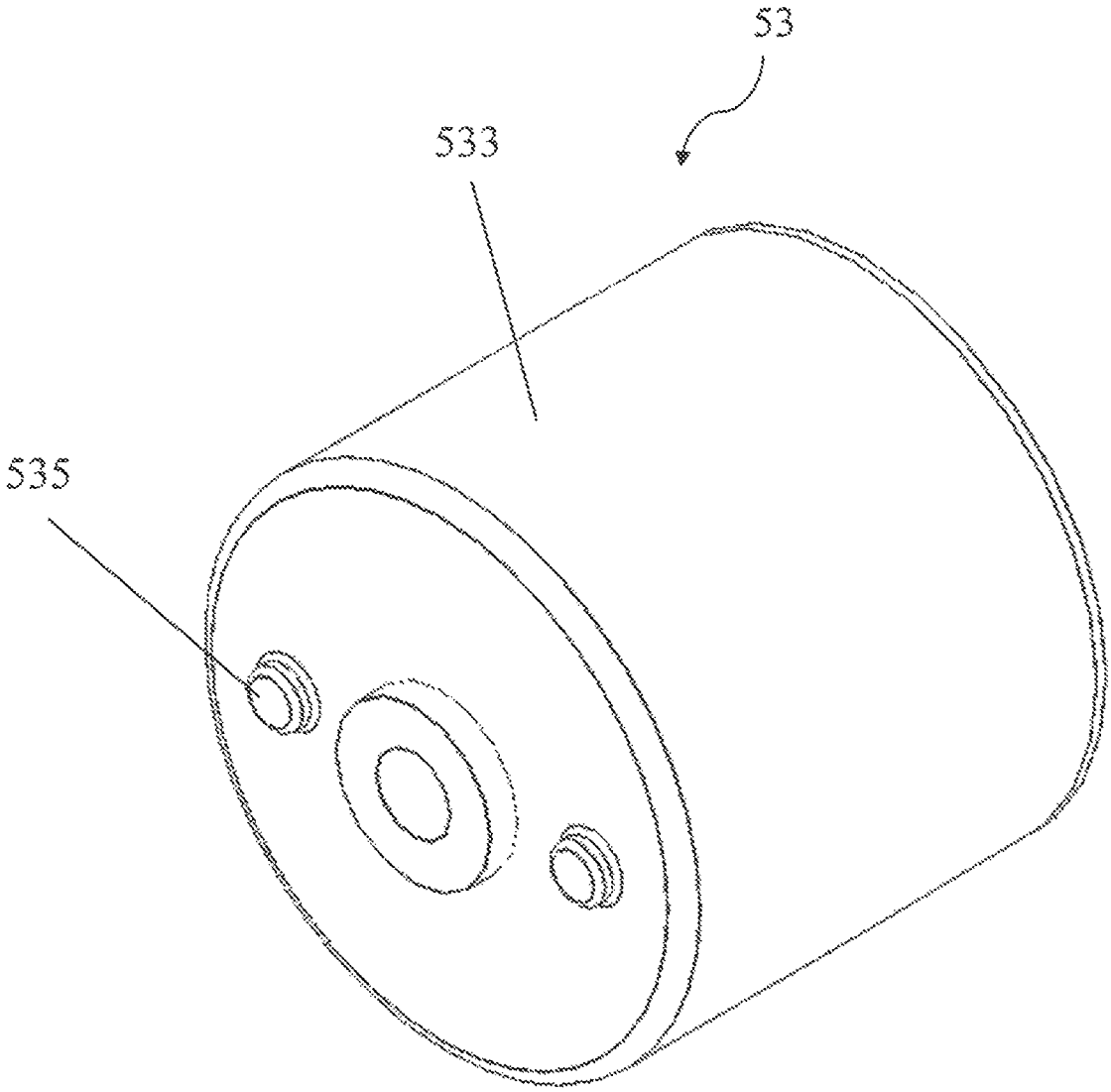
FIG. 8 is a view of a rotor of the motor of the gear pump of FIG. 1.
Figure 9:
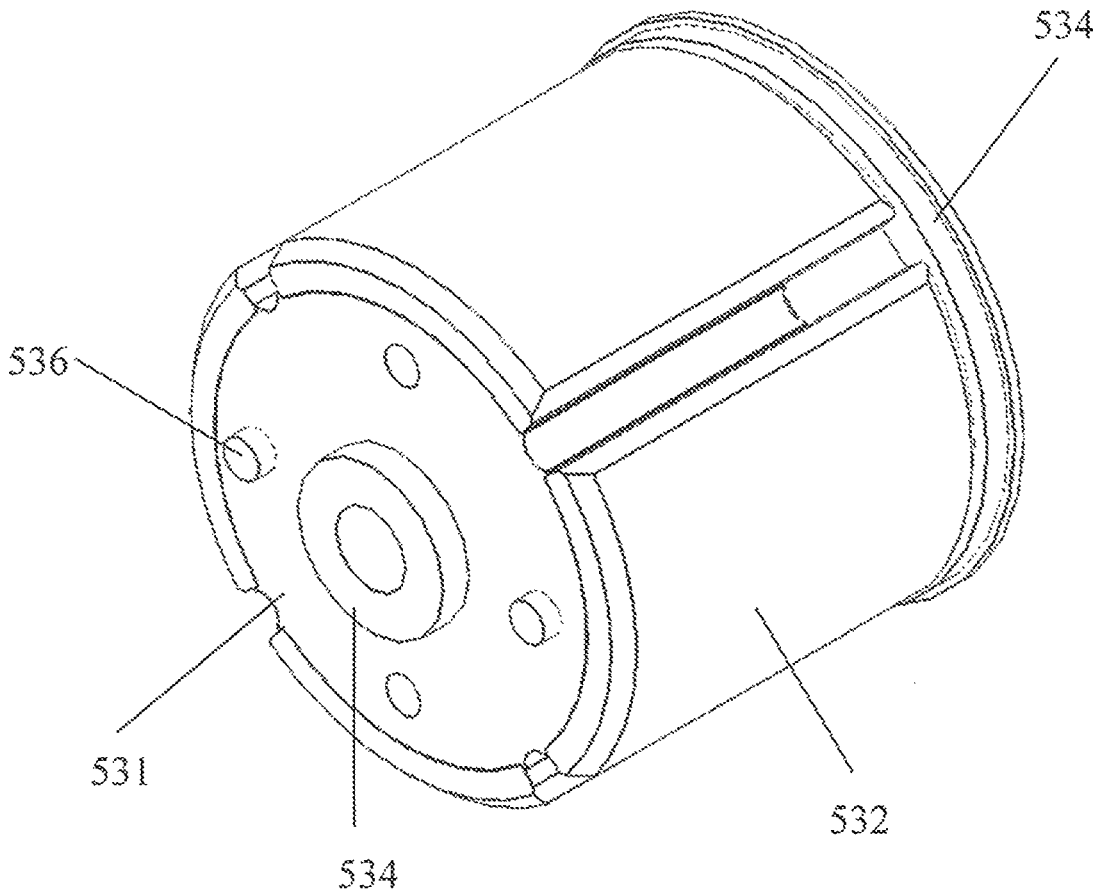
FIG. 9 is a view of the rotor of FIG. 8, with an outer housing removed.
Figure 10:
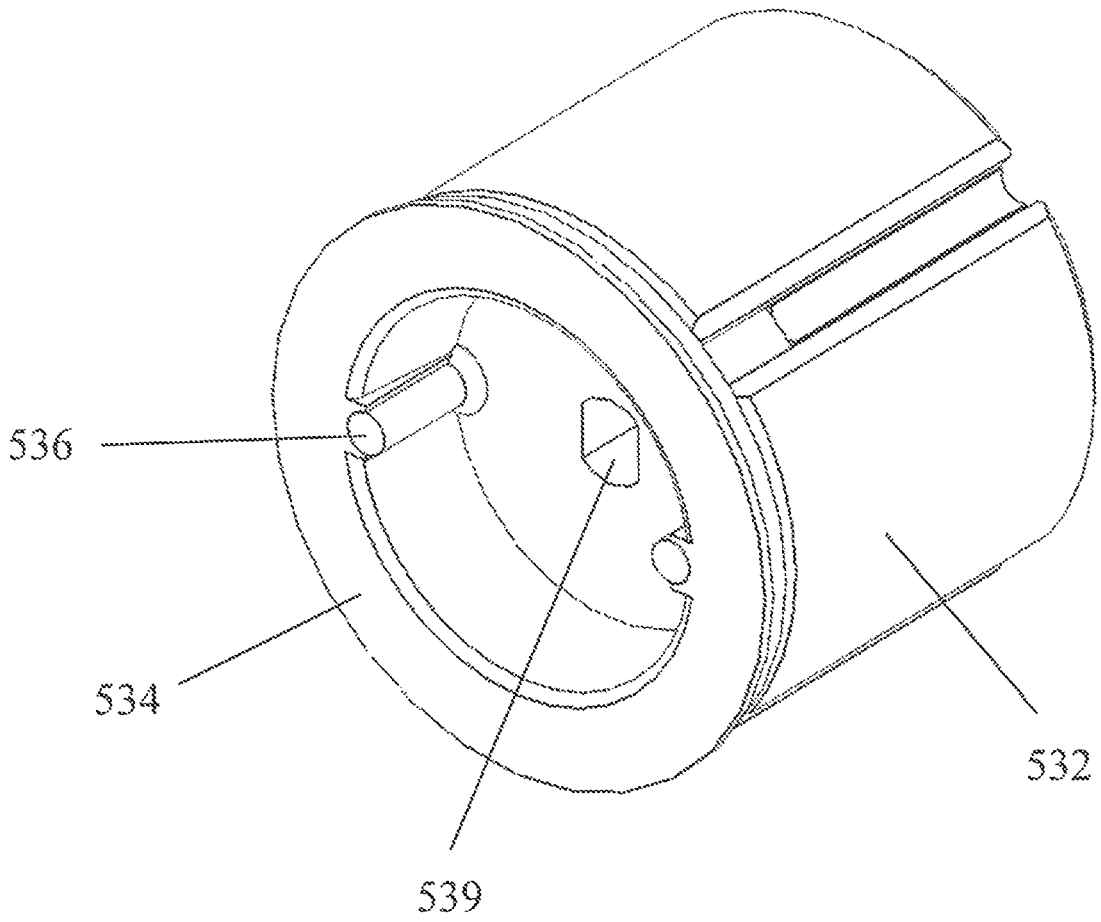
FIG. 10 is similar to FIG. 9, but viewed from another angle.
Figure 11:
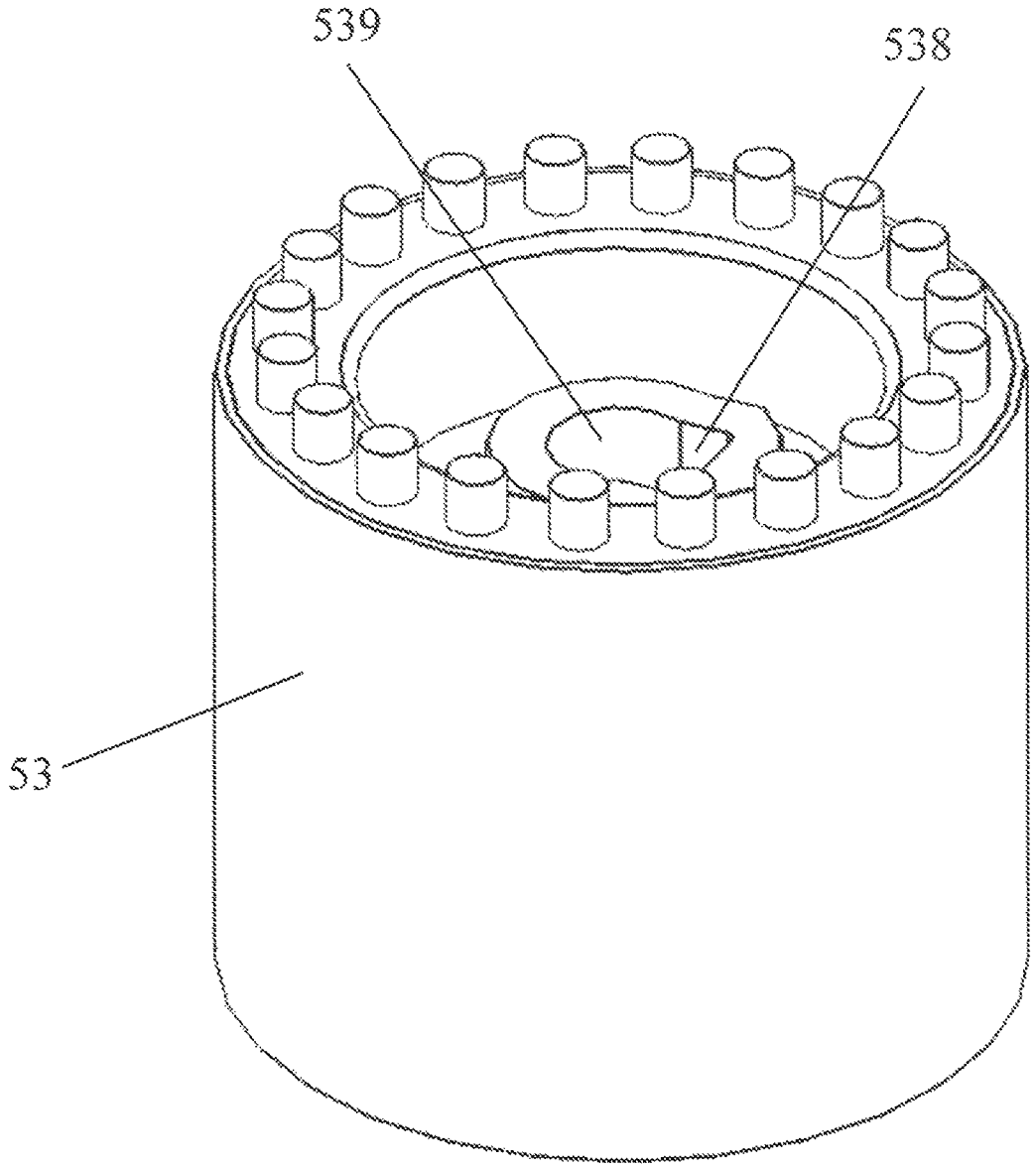
FIG. 11 is a perspective view of the rotor according to another embodiment.
Figure 12:
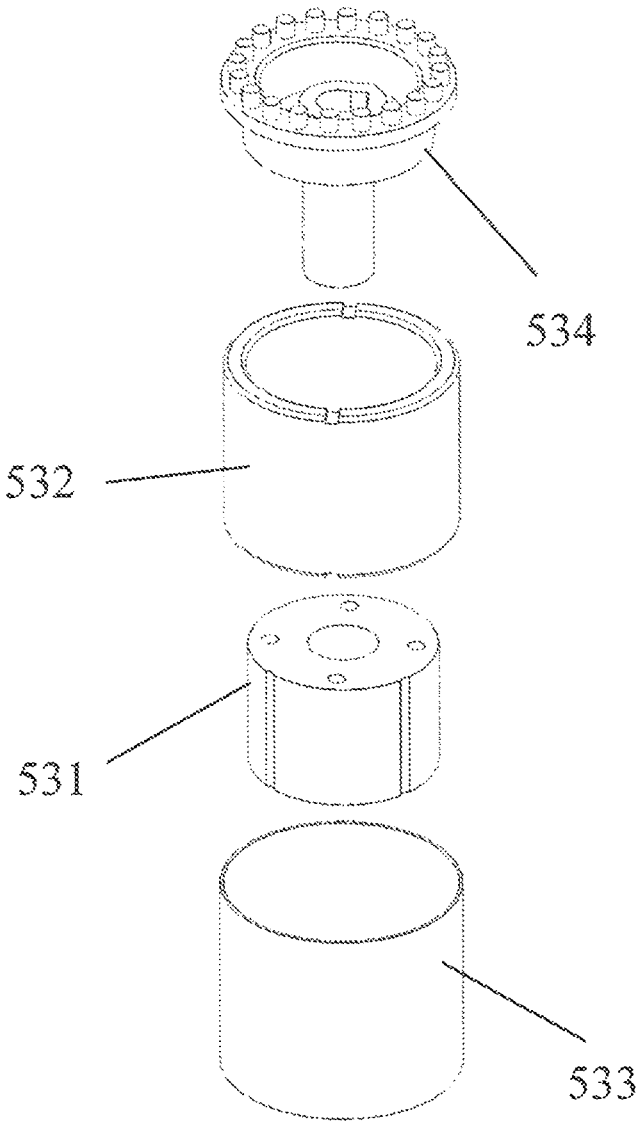
FIG. 12 is an exploded view of the rotor of FIG. 11.
Figure 13:
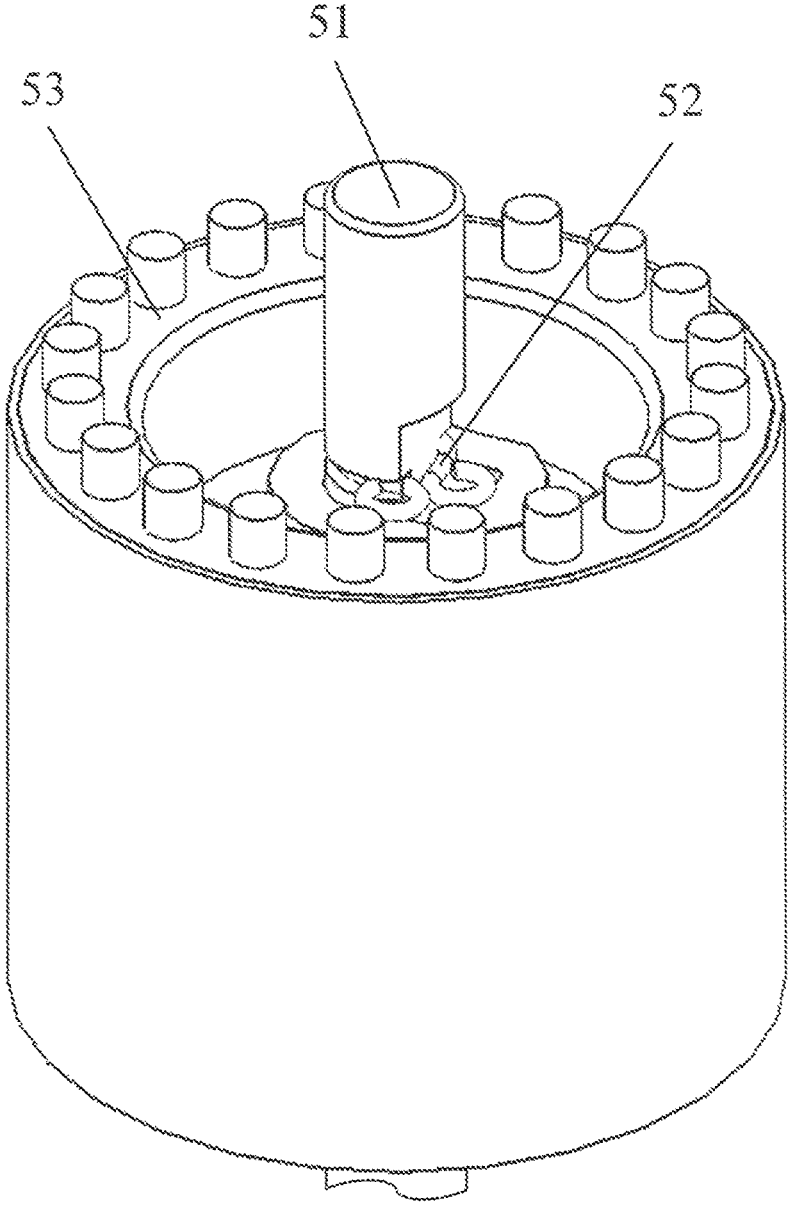
FIG. 13 shows the rotor of FIG. 10 assembled with the driving shaft.

Referring to FIG. 8 to FIG. 10, the rotor 53 is an integrated structure formed by a two-step forming process, which includes a rotor core 531 surrounding the driving shaft 51, magnets 532 surrounding the rotor core 531, and the housing 533 surrounding the magnets 532. The magnets of the rotor 53 are segmented sintered magnets. In forming the rotor, the rotor core 531 is placed within the housing 533, with a space formed between the housing 533 and the rotor core 531 in which the magnets are disposed. As such, the magnets 532 are positioned by the rotor core 531 and the housing 533. Thereafter, a secondary molding process may be performed to form an insulating member 534. The insulating member 534 and the housing 533 cooperatively encapsulate the magnets 532 completely to enhance the chemical resistance of the entire rotor 53 and prevent corrosion by acidic liquid. Preferably, the magnets 532 are magnetized after molding of the insulating member 534.

The rotor 53 further includes a pair of magnetization indicators such as posts 535 (FIG. 8) to indicate the positions of the magnets 532. Specifically, the magnetization indicators are a pair of protruding posts 535 at one axial end of the housing 533 of the rotor 53. During the process of magnetizing the magnets 532, the protruding posts 535 are aligned with positioning holes in a fixture. Because the positional relationship between the protruding posts 535 and the magnets 532 are known, the positions of the magnets 532 can be determined based on the positions of the protruding posts 535. In addition, in the process of molding the insulating member 534, the protruding posts 535 may be used to position the housing 533 in the mold. The housing 533 of the rotor 53 forms recesses at a back side corresponding to the protruding posts 535. The rotor core 531 forms positioning posts 536 corresponding to the recesses (FIGS. 9, 10) and distal ends of the positioning posts 536 are received in the recesses of the housing 533 to position the rotor core 531 relative to the housing 533.

Figure 14:
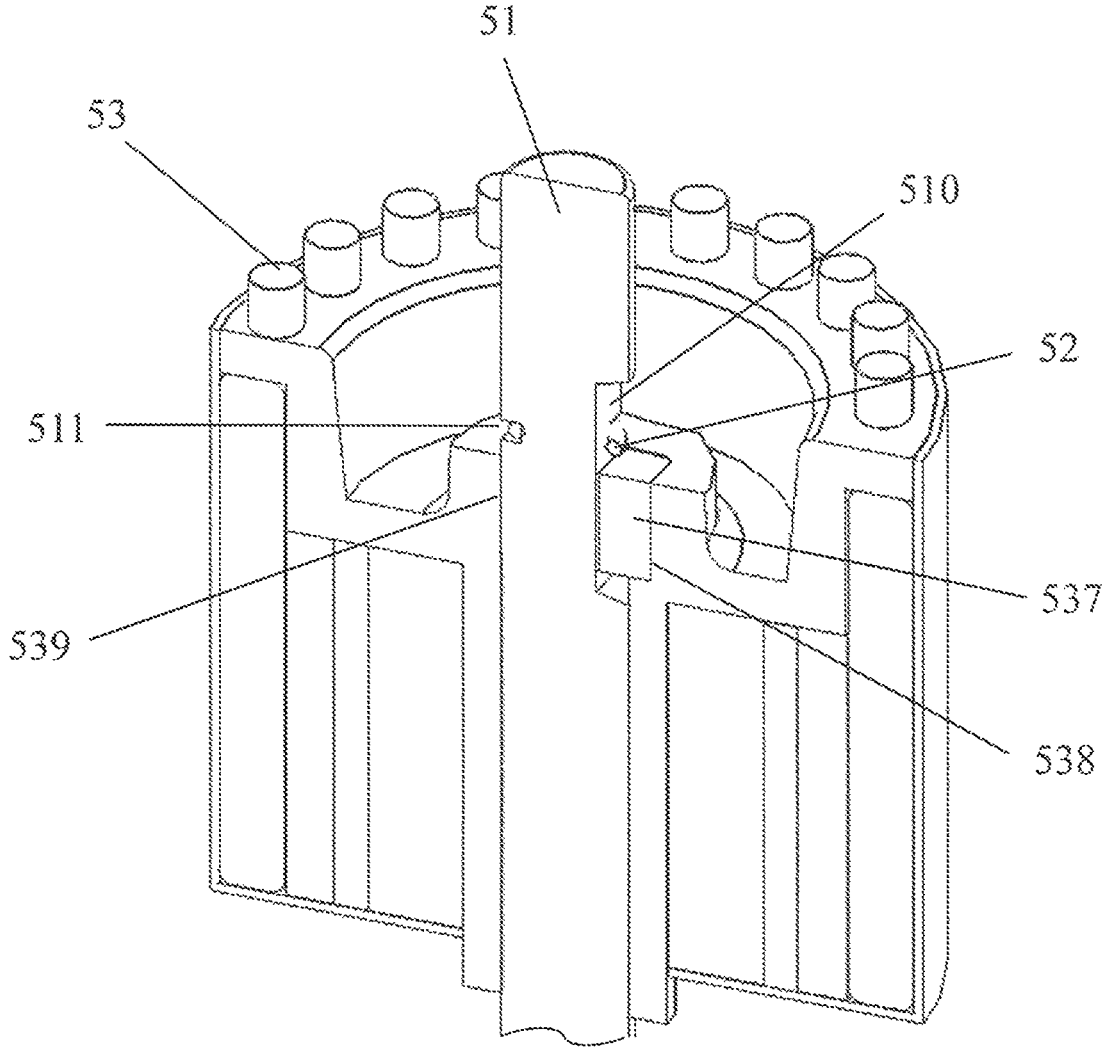
FIG. 14 is a sectional view of FIG. 13.

In the embodiment illustrated in FIG. 10, the rotor 53 defines a through hole 539 with a waist or double flat sided shape cross section. The cross section of the part of the driving shaft 51 received in the rotor 53 has a corresponding complementary shape. As such, the rotor 53 and the driving shaft can loosely engage in the circumferential direction while rotatable along with each other. The rotor 53 and the driving shaft 51 may form a minor gap there between without permitting relative rotation between the rotor 53 and the driving shaft 51. The loose engagement greatly facilitates the removal and assembly of the rotor to the driving shaft 51. The rotor 53 and the driving shaft 51 may engage in another manner in an alternative embodiment. In another embodiment shown in FIGS. 11 to 14, the middle of the rotor 53 forms a through hole 539 and a keyway 538 in communication with the through hole 539. A key 537 (FIG. 14) is locked in the keyway 538 to limit relative rotation between the rotor 53 and the driving shaft 51.

The through hole 539 extends axially through the rotor 53. An inner diameter of the through hole 539 is approximately the same as or slightly greater than the outer diameter of the driving shaft 51, such that the driving shaft 51 and the rotor 53 may form a loose engagement when the driving shaft 51 is inserted into the through hole 539. The keyway 538 is axially recessed from one end of the rotor 53 away from the pump cylinder 20, which has an axial depth far less than an axial height of the rotor 53, such that a step is formed on the rotor 53 to axially support the key 537. Preferably, the keyway 538 has a square cross section and has a tangential width. The keyway 538 connects with the through hole 539 in a transverse direction. The connection area between the keyway 538 and the through hole 539 has a width, i.e. the tangential width of the keyway 538, less than a diameter of the through hole 539. The driving shaft 51 has a cutting groove 510 at a location corresponding to the keyway 538 such that the driving shaft 51 at that location has a D-shaped cross section. In assembly, the cutting groove 510 is aligned with the keyway 538, and the key 537 in the keyway 538 engages a flat surface of the cutting groove 510 in the driving shaft 51 to limit relative rotation between the driving shaft 51 and the rotor 53.

Figure 15:
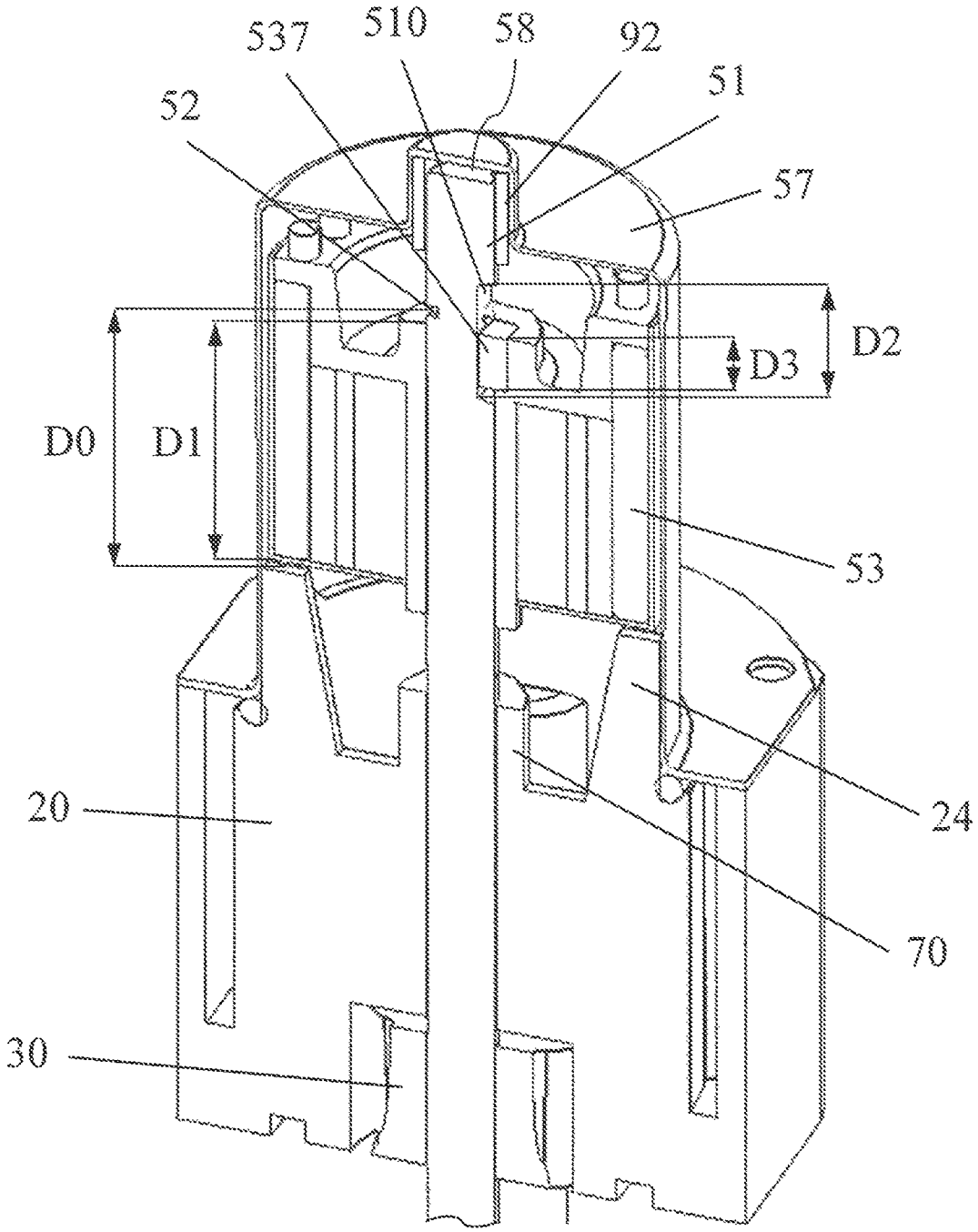
FIG. 15 illustrates the pump cylinder of FIG. 6 assembled with the rotor of FIG. 11.

In the embodiment shown in FIG. 15, the cutting groove 510 of the driving shaft 51 has an axial height D2 greater than an axial height D3 of the key 537, which facilities the assembly of the key 537. In addition, after assembly, the key 537 is disposed in the cutting groove 510 but does not fill up the cutting groove 510. This permits a certain amount of axial movement of the rotor 53 relative to the driving shaft 51 to optimize the induction magnetic field of the rotor 53. The maximum movable distance of the rotor is defined by the height difference between the cutting groove 510 and the key 537, i.e. D2-D3. To limit the axial movement of the rotor 53, an annular locking groove 511 is formed in the driving shaft 51. The locking groove 511 is positioned above the keyway 538, i.e. above the rotor 53. A retaining ring 52 is locked in the locking groove 511. When the rotor 53 moves in a direction away from the pump cylinder 20 such that the key 537 contacts the retaining ring 52, the rotor 53 is prevented from further movement. The movement of the rotor 53 toward the pump cylinder 20 is limited by the pump cylinder 20 such as the baffle blocks 24. As such, the axial movement of the rotor 53 is limited. Acceptable movement of the rotor along the driving shaft 51 is less than the distance DO between the tip of the baffle barrier 24 and the locking groove 511 less the distance D1 between the points on the rotor which confronts the tip of the baffle barrier and the locking groove.

In the present embodiment, the magnets 532 of the rotor 53 are configured as an adhered integral annular magnet. Preferably, the annular magnet 532 is obliquely magnetized to reduce the torque ripple of the motor. However, oblique magnetization reduces the efficiency of the magnet 532 and, therefore, the electrical current needs to be increased. Typically, the electrical current is preferably not greater than 1.2 A. In addition, the housing 533 and sealing member 57 of the rotor 57 may be made of a non-magnetic metal material. This configuration may allow a radial gap between the outer surface of the rotor housing 533 and the inner surface of the sealing member 57 to decrease to below 1.6 mm. Preferably, the radial gap between the outer surface of the rotor housing 533 and the inner surface of the sealing member 57 is about 1.2 mm. This can reduce the gap between the stator and rotor to reduce magnetic resistance, thus increasing the power of the motor.

In addition, in the first embodiment described above, one end of the driving shaft 51 at the pump cylinder 20 and a middle portion of the driving shaft 51 are supported by the bearings 60, 70, and the other end of the driving shaft 51 at the motor 50 is loosely engaged. Therefore, the driving shaft 51 is similar to a cantilever structure. As such, a length of the driving shaft 51 between the first bearing 60 and the second bearing 70 is not less than a length of the driving shaft 51 between a radial plane on which a center of gravity of the rotor is located and the second bearing 70. However, in the present embodiment, a fifth bearing 92 is disposed in the third shaft hole 58 of the closed end of the sealing member 57. The fifth bearing 92 and the first, second bearings 60, 70 form a three-point support at the ends and middle of the driving shaft 51. As such, the driving shaft 51 is not only supported at opposite sides of the driving gear 30, but it is also supported at opposite ends of the rotor 53 of the motor, such that the stability of the rotor 53 during rotation is further enhanced which further reduces vibration and noise. Therefore, the rotor core 531 of the rotor 53 may have a greater axial height to intensify the magnetic field. When the gear pump of the present invention starts up, the windings 56 of the stator 55 of the motor 50 are energized to produce a magnetic field which interacts with the magnetic field of the rotor 53 to drive the rotor 53 to rotate. The rotor 53 in turn drives the driving shaft 51 as well as the driving gear 30 connected to the driving shaft 51 to rotate. Rotation of the driving gear 30 causes the driven gear 40 meshed with the driving gear 30 to rotate. During rotation of the driving gear 30 and driven gear 40, engaging and disengaging of the teeth of the gears 30, 40 cause shrinkage and expansion of the space, such that the fluid is pressurized or driven to move. In this embodiment, because the output shaft 51 of the motor 50 is directly inserted into the driving gear 30 and acts as the driving shaft of the driving gear 30, the coaxiality of the motor 50 and the driving gear 30 can be ensured, and the transmission loss is reduced. In addition, the first and second bearings 60, 70 are disposed between the driving shaft 51 and the pump body 10, and between the driving shaft 51 and the pump cylinder 20, to support the driving shaft 51 for rotation. The first and second bearings 60, 70 fill the gap between the driving shaft 51 and the pump body 10 and the gap between the driving shaft 51 and the pump cylinder 20, which prevent wobbling of the driving shaft 51. The two washers 100 disposed at opposite sides of the gears 30, 40 separate the gears 30, 40 from the pump body 10 and from the pump cylinder 20, which effectively avoids noise due to collision between the driven gear 40 and the pump cylinder 20.

A ring of small projections are shown extending axially from one end of the rotor. These projections may be used for balancing of the rotor by providing material which can be easily removed without adversely affecting the operation of the rotor.

After the gear pump of the present invention is used for a period of time, components such as the driving gear 30, driven gear 40, bearings 60, 70 will be worn or damaged which may need to be replaced. In the present invention, the driving shaft 51 is loosely engaged with the rotor 53 and the sealing member 57 in the motor 50. Therefore, when the pump body 10, pump cylinder 20 need to be replaced, the pump body 10, pump cylinder 20 as well as the driving shaft 51 as a whole may be removed from the motor 50 for replacement of the damaged components. Thus, it is not necessary to replace the entire gear pump, especially in situations that the motor 50 can still be used, which greatly reduces the maintenance cost. After the damaged components are replaced, because the driving shaft 51 is loosely engaged with the rotor 53 and the sealing member 57, assembly of these components can be easily performed.

In view of the foregoing, in the gear pump as described above, the driving shaft is directly inserted into the interior of the rotor or, put differently, the motor driving shaft directly rotates the driving gear, such that the gear pump has a simple structure. Washers disposed between the end surface of the driving gear and the pump body and between the end surface of the driving gear and the pump cylinder can effectively avoid collision between the gear and the pump body and between the gear and the pump cylinder. The groove is formed in the surface of the washer corresponding to the gears, which extends to where the driving and driven gears are meshed with each other, such that, during operation of the gear pump, the fluid can enter between the end surface of the gear and the washer for lubrication to reduce friction between the gears and the washer.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

For example, the washers between the pump body and the driving, driven gears are shown as of an integral type, but may be of a separate type, i.e. the washer between the pump body and the driving gear, and the washer between the pump body and the driven gear may be separately formed and then mounted there between.

The invention claimed is:

1. A gear pump comprising:

a pump cylinder, comprising:

a driving gear; and a driven gear, the driving gear and the driving gear being meshed with each other and disposed in the pump cylinder;

a driving shaft, rotatably supported by the pump cylinder, and the driving gear being mounted to or integrally formed with the driving shaft; and a motor, comprising:

a rotor attach to the driving shaft;

a stator surrounding the rotor; and a sealing member disposed between the rotor and the stator, a gap being formed between the sealing member and the rotor to allow the rotor to rotate, wherein the sealing member is a cylindrical structure with an open end and an opposite closed end, an end of the pump cylinder is inserted into the open end of the sealing member to contact an inner surface of the sealing member, and the open end of the sealing member is connected with the pump cylinder to prevent a leakage of a fluid in the gear pump, wherein the driving shaft and the rotor are rotatable along with each other, wherein the driving shaft and the rotor are engaged to permit a relative movement in an axial direction without permitting a relative movement in a circumferential direction after the driving shaft is assembled to the rotor, wherein the end of the pump cylinder has an annular flange axially protrudes therefrom, and the annular flange is inserted into the open end of the sealing member to contact the inner surface of the sealing member, wherein the end of the pump cylinder facing the motor further comprises at least one baffle block which extends radially inwardly from the annular flange and axially to form a gap between the baffle block and the rotor, and the fluid rotating along with the rotor impinges on the at least one baffle block to form turbulence in the fluid, and wherein two baffle blocks are symmetrically disposed with respect to the driving shaft, and a radial distance between the at least one baffle block and the driving shaft gradually increases in a direction away from the pump cylinder.

2. The gear pump of claim 1, wherein the sealing member is made of a non-magnetic metal material.

3. The gear pump of claim 1, wherein the motor further comprises an outer housing, an end of the outer housing adjacent to the pump cylinder has a through hole, and the open end of the sealing member extends out of the outer housing via the through hole to connect the pump cylinder.

4. The gear pump of claim 1, wherein the end of the pump cylinder further has an end surface located outside the annular flange, the sealing member further comprises a radial flange which extends radially outwardly from the open end of the sealing member, the radial flange is attached to the end surface of the pump cylinder, and a sealing ring is disposed between the end surface of the pump cylinder and the radial flange of the sealing member.

5. The gear pump of claim 1, wherein an outer diameter of the annular flange is substantially the same as an inner diameter of the open end of the sealing member.

6. The gear pump of claim 1, wherein a radial inner end of the at least one baffle block is spaced a distance from the driving shaft rotor to form a fluid channel therebetween to allow passage of the fluid.

7. The gear pump of claim 1, wherein the annular flange of the pump cylinder is an outer annular flange, the pump cylinder further has an inner annular flange located inside the outer annular flange, the inner annular flange has a driving shaft hole configured to allow passage of the driving shaft, a radial inner end of the at least one baffle block is spaced a distance from the inner annular flange to form a fluid channel therebetween to allow passage of the fluid.

8. The gear pump of claim 1, further comprising a pump body connected with the pump cylinder, wherein the driving shaft extends into the pump body and further rotatably supported by the pump body.

9. The gear pump of claim 8, wherein the pump body has a fluid inlet and a fluid outlet via which the fluid flows into and out of the pump body, respectively.

10. The gear pump of claim 8, wherein a first washer is disposed between the pump body and one end surface of the driving gear, a second washer is disposed between the pump cylinder and the other end surface of the driving gear, and the first washer and the second washer are made from stainless steel.

11. The gear pump of claim 1, wherein the rotor comprises a housing, a rotor core received in the housing, a magnet disposed between the rotor core and the housing, and an insulating member, the insulating member is directly formed over the housing, rotor core and magnet to form an integral structure by a molding process, the magnet and rotor core are sealed in a closed space formed by the housing and the insulating member, and the insulating member forms a through hole for receiving the driving shaft.

12. The gear pump of claim 11, wherein the housing is made of a non-magnetic metal material.

13. The gear pump of claim 1, wherein the rotor defines therein a through hole, a portion of the through hole has a non-circular cross section, a portion of the driving shaft received in the through hole has a corresponding cross section, such that relative rotation between the rotor and the driving shaft is limited.

14. The gear pump of claim 1, wherein the rotor defines therein a through hole and a keyway in communication with the through hole, a key is disposed in the keyway, the driving shaft forms a cutting groove at a location corresponding to the key, matching surfaces of the key and the driving shaft are planar surfaces, such that relative rotation between the rotor and the driving shaft is limited.

15. The gear pump of claim 14, wherein an axial height of the cutting groove is greater than an axial height the key, a locking groove is formed in the driving shaft corresponding to the cutting groove, the locking groove is located on a side of the rotor remote from the pump cylinder, and a retaining ring is disposed in the locking groove to limit axial movement of the rotor.

16. The gear pump of claim 1, wherein a clearance is formed between the driving shaft and a driving shaft hole of the pump cylinder, and a fluid in the pump cylinder is driven to enter the sealing member via the clearance.

* * * * *